United States Patent [19]

Goulter

[11] Patent Number: 4,535,911

[45] Date of Patent: Aug. 20, 1985

[54] TRASH CONTAINER ATTACHMENTS FOR SUPPORTING PLASTIC BAGS

[75] Inventor: Victor H. Goulter, San Francisco, Calif.

[73] Assignee: David Pressman, San Francisco, Calif. ; a part interest

[21] Appl. No.: 607,797

[22] Filed: May 7, 1984

[51] Int. Cl.[3] ..... B65D 90/04

[52] U.S. Cl. ..... 220/404; 220/95; 220/96; 220/1 T

[58] Field of Search ..... 220/404, 403, 95, 96, 220/1 T, 85 H; 383/12, 13, 14; 248/95, 96, 100

[56] References Cited

U.S. PATENT DOCUMENTS

| | | | |
|---|---|---|---|
| 871,072 | 11/1907 | Seidenspinner | 24/343 |
| 1,219,969 | 3/1917 | Lowe | 220/95 |
| 2,353,555 | 7/1944 | Gore | 220/96 X |
| 2,609,120 | 9/1952 | Williams | 220/95 X |
| 4,332,361 | 6/1982 | McClellan | 248/95 |
| 4,418,835 | 12/1983 | Watts | 220/1 T X |

*Primary Examiner*—Steven M. Pollard
*Attorney, Agent, or Firm*—David Pressman

[57] ABSTRACT

A plastic grocery bag (34) with cut-out carrying handles (35) is held in an open condition from top of a common trash basket or container (32) by means of attachments (49) for the top of such container. In one embodiment, a pair of attachments (49) are provided, each bent in a configuration whereby it is arranged to snap over the top edge (44) of the container and provide a self-supporting function so that the attachment stands up from such edge. Each attachment has a pair of upstanding ears (42), or a single, wide, horizontal support (51), around which one handle of the plastic bag is placed. Alternatively, each wire attachment can be bent to provide hooks (65) at its ends which loop under and grasp the edge of the container. As another alternative, each attachment can be a single or metal bent strip (67)(or a pair of separate members (75)) with upstanding ears (66) and a snap-type slot (67) or a pair of thumbscrews (69). As a further alternative, the attachment can be a simple strip with securement by adhesives (105) or nuts and bolts (114). As a still further alternative, the attachment can be a bent endless loop or hoop of wire which is folded to have a U-shaped configuration when viewed from the side, with the legs of the "U" having unequal lengths, and which has two curved pressure portions (123) when viewed from its face, with one of the pressure portions (128) having a plurality of bends (124) therein so as to form a pair of rests which limit downward movement when said "U" is fitted over the edge of said container, whereby the bight portions of said "U" form a pair of support ears (126) which extend up from said container.

19 Claims, 40 Drawing Figures

120
126a
125a
124a
121a
122a
126
125
124
121
127a
122
127
128
123

120
126a
125
124
122
121
127
127a
128
126
125a
124a
121a
122a
123

120
46
37
128
122
122a
123

120
128
123
37
37

120
128
123

120
133

120
131

120
125
129
123
128

120
133

37
56a 56
37

TRASH CONTAINER ATTACHMENTS FOR SUPPORTING PLASTIC BAGS

BACKGROUND

1. Field of the Invention

This invention relates to metal or plastic support attachments, in particular, to pairs of attachments for the top of trash or waste baskets or containers for the purpose of suspending or holding plastic bags in such containers.

2. Description of Prior Art

In the past, plastic trash bags have been placed in trash baskets as liners for easy and sanitary disposal of trash which is thrown therein. Support for the bag has been obtained by providing it with extra length to enable its top to be folded down over the top and part way down the outside of the basket. One of the problems with this arrangement is that as the bag is filled or being filled, it tends to slip down from the top of the basket so that it must be re-suspended or re-positioned from time to time. Another disadvantage is the extra length of plastic material, which is inefficiently used. Still another drawback is that a separate device, either a tie wire (twist), plastic pull-through, or other means, must be used to close the top of the bag when it is filled.

Also, paper grocery paper bags have been used as liners in trash baskets by standing the bags open-end-up in such baskets, thereby to receive waste for disposal.

One disadvantage of paper bags is that they tend to fall apart when anything wet comes into contact with them. To remedy this, and to provide bags which are easier to carry, retailers have recently begun to replace paper bags with plastic carrying bags. The plastic bags will not fall apart when wet and are easier to carry because they have cut-out carrying handles or loops. Retailers recommend that these plastic bags be reused for a variety of purposes. They will not, however, stand upright in trash baskets, especially when such baskets are filled or being filled, as paper bags are able to do. They are also too short to fold down over the outside of a trash basket, as can be done with plastic trash bags.

OBJECTS AND ADVANTAGES

Accordingly one object and advantage of the present invention is to provide a means for enabling plastic carrying bags to be easily recycled as trash bags. Other objects and advantages are to provide such a means which is simple in design, easily-mountable, enables one to attach plastic carrying bags by its handles, holds the top of the bag open for easy deposit of trash or waste, enables such bags to hang down inside the trash basket for complete filling, even when using extra downward force with hand or foot when necessary, enables such bags to be reused and not thrown away, is simple to manufacture and package, and can be left in position when other kinds of plastic bags are used, even if paper bags are sometimes used. Further objects and advantages of my invention will become apparent from a consideration of the drawings and ensuing description thereof.

BRIEF DESCRIPTION OF DRAWINGS

FIG. 38 is a perspective view of the support attachment of FIG. 29 shown fitted in reverse so as to clear the support gussets.

DETAILED DESCRIPTION OF THE PREFERRED EMBODIMENT

Figure 1:
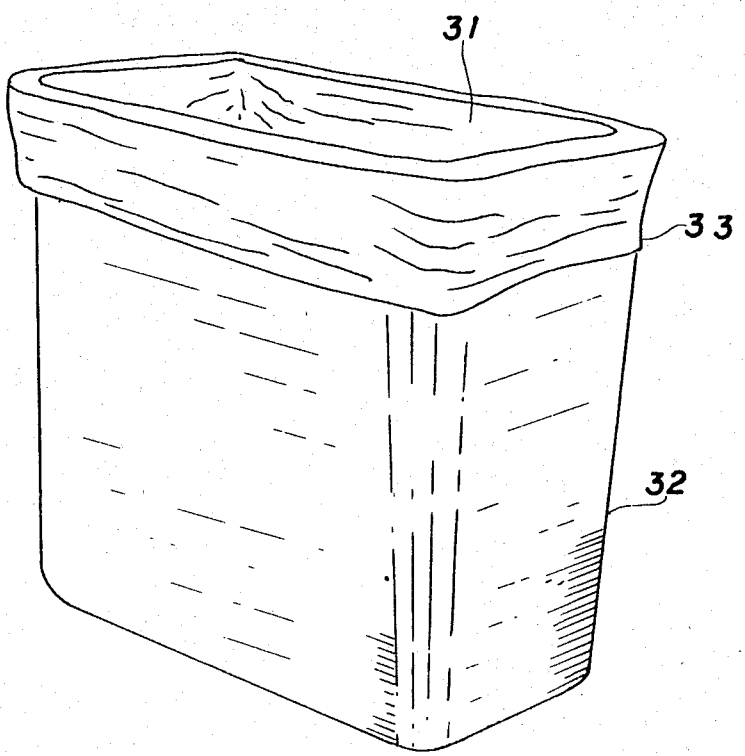
FIG 1 PRIOR ART
FIG. 1 is a perspective view of a prior art plastic trash bag placed in a trash basket.

FIG. 1 shows a plastic prior art bag 31 fitted onto a trash container 32. A top portion 33 of bag 31 is then turned down around the outside of container 32. When it is filled with trash, top 33 is pulled off basket 32 and closed with a wire twist or other tie means (not shown).

As stated, this type of arrangement is fraught with disadvantages, namely, a large area of material of bag 31 is wasted, the foldover means of holding shown is not totally effective since bag 31 will tend to slip into container 32 in use, whereupon it must be repositioned, bag 31 must be closed with separate ties, etc.

Figure 2:
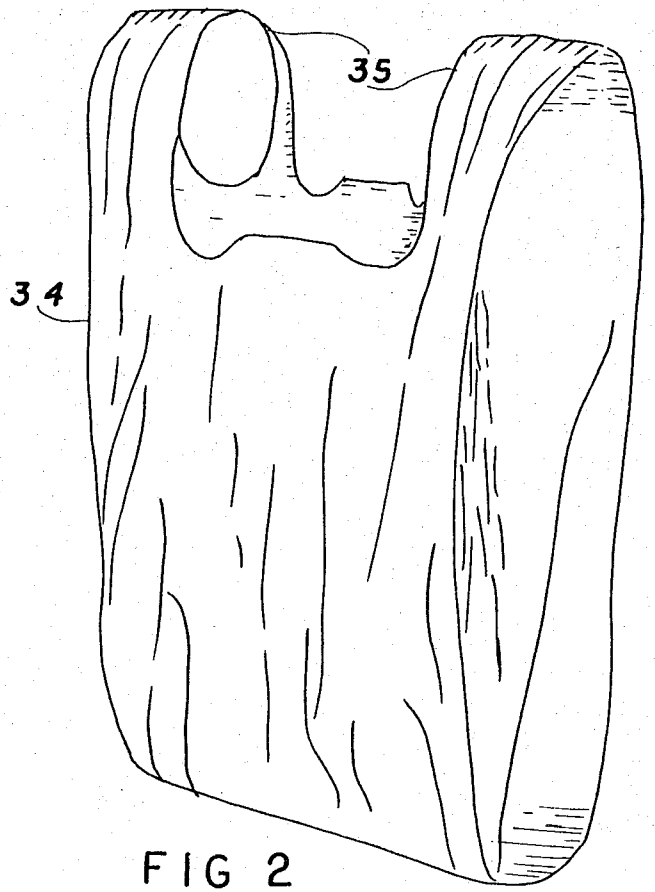
FIG. 2 is a perspective view of a plastic carrying bag with cut-out handles.

FIG. 2 shows a typical newly implimented plastic carrying bag 34, with cut-out carrying handles 35. This type of bag now being used for packing and carrying groceries and other items and is taking the place of the usual paper bags.

Figure 3:
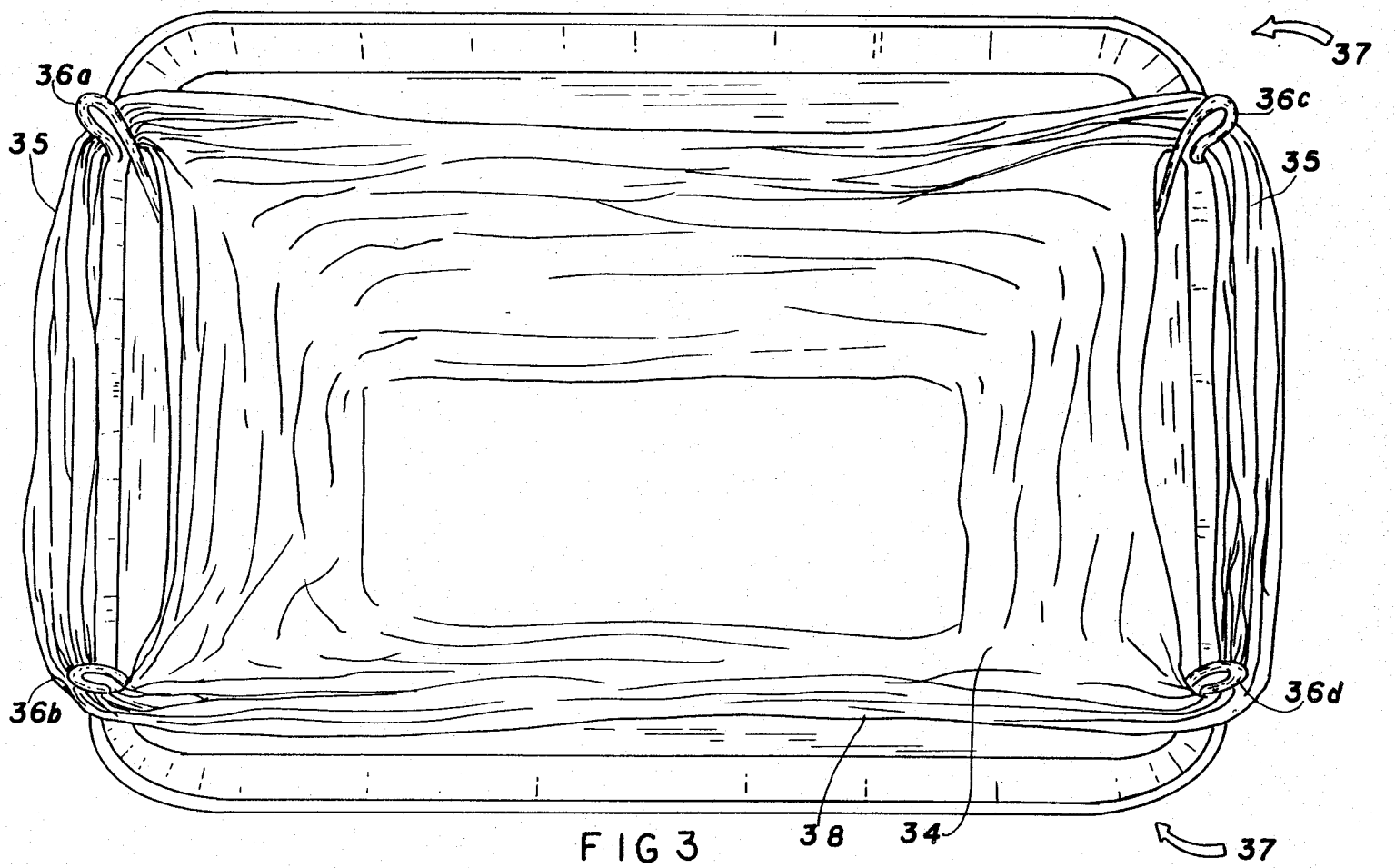
FIG. 3 is a perspective top view of the plastic carrying bag suspended by a support attachment of the present invention fitted to a trash basket.

FIG. 3 shows a trash basket 37, with a plastic bag 34 of the type shown in FIG. 2 being supported by its cut-out handles 35 and **35*a* which are positioned on respective parts of attachments 36*a* and 36*b* on the left and 36*c* and 36*d* on the right. A top portion 38 of bag 34 is thus stretched wide open by supports 36*a*–36*d*, thereby to facilitate the deposit of trash therein. When bag 34 is filled, cut-out handles 35 and 35*a*** can be easily unhooked from the supports, drawn tightly together over the trash and tied together. The filled bag is then easily removed and a new bag can be installed in the container.

Figures 4, 5, 6:
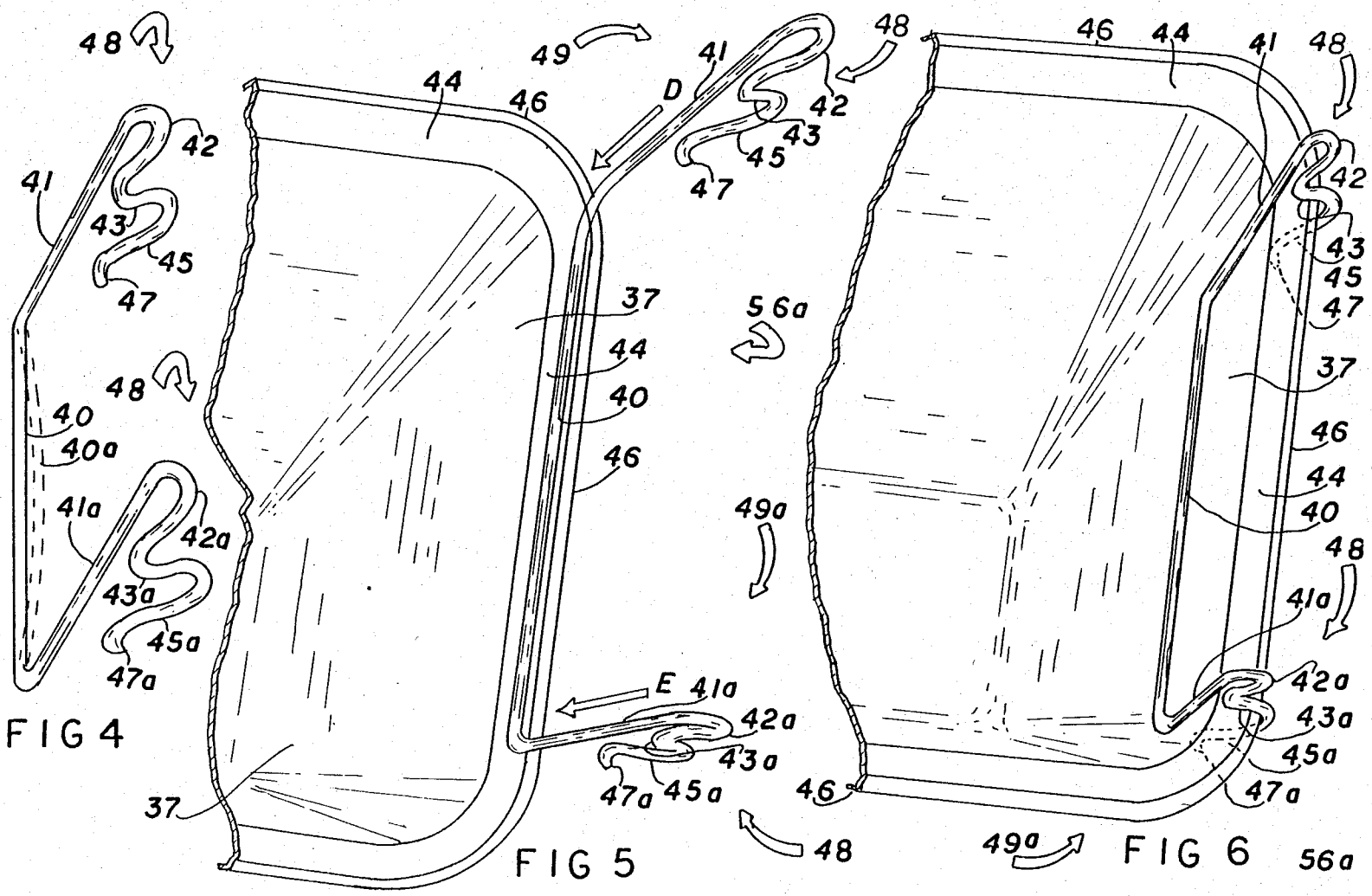
FIG. 4 is a perspective view of the wire support attachment of the present invention.
FIG. 5 is an exploded perspective view of the wire support attachment of FIG. 4 and one side of a trash basket.
FIG. 6 is a perspective view of the support attachment of FIG. 4 after fitting onto the side of the trash basket.

FIG. 4 shows one of the support attachments. It is made from wire which is bent to the shape indicated. A horizontal section 40 is shown straight for straight-sided baskets, but can be made curved, as shown in **40*a* for curved sided baskets. Horizontal section 40 is approximately 150 mm (6 in) long. Two vertical sections 41 and 41*a*, each approximately 50 mm (2 in) long, extend up at right angles to section 40. Then two serpentine portions 48 are bent outward and down at 42 and 42*a*. Serpentine portions can be from 12 to 18 mm ($\frac{1}{2}$ to $\frac{3}{4}$ in) long. Serpentine portions 48 have an outward and slightly upward bend to form two rests 43 and 43*a* which seat on rim 44** on the top of the basket when the unit is fitted.

In order to secure the support attachments firmly in position, serpentine portion has a downward and inward bend to form pressure tanges 45 and **45*a* which press against the basket's outer rim 37. Lastly the serpentine portion has outward curves to form short guides 47 and 47*a*; these direct tangs 45 and 45*a* around basket rim 46** when the support unit is being fitted.

This fitting proceedure is clearly shown in the exploded view of FIG. 5. Here supports 49 and **49*a* are positioned above basket side 56*a*. Arrows D and E show the direction in which the support attachment is moved so that horizontal portion 40 and vertical portions 41 and 41*a* slide against inside face of basket 37, while guides 47 and 47*a* direct pressure tangs 45 and 45*a* along the outside until stops 43 and 43*a* meet top 44** of the basket as shown in FIG. 6.

The support attachments may be made from any suitable material with adequate thickness for self retention, preferably from 12 to 15 gage steel wire. However, many non-ferrous metals and plastics are also suitable.

FIGS. 7–9

Figures 7, 8, 8A, 9:
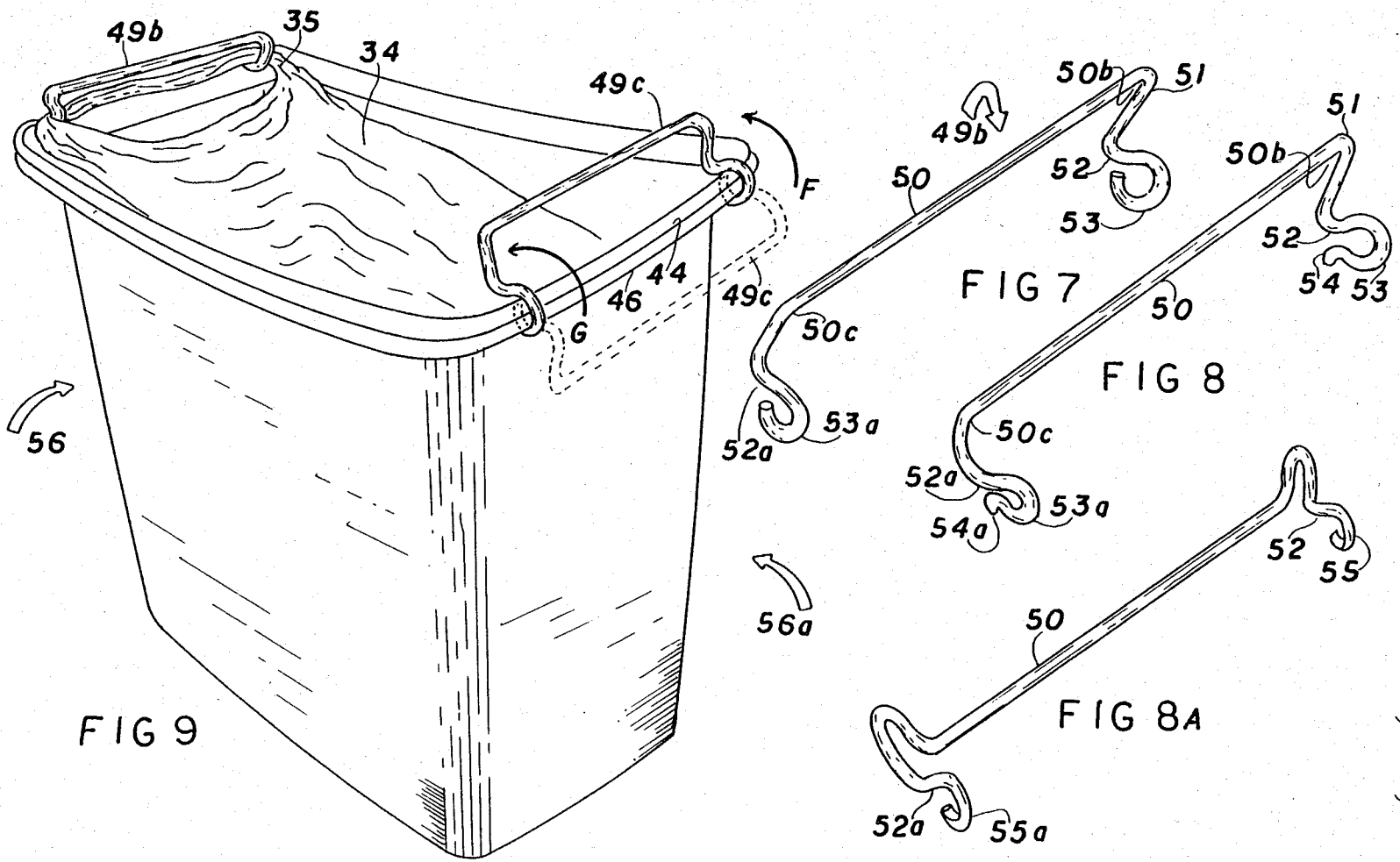
FIG. 7 is a perspective view of another form of wire support attachment according to the invention.
FIG. 8 is a perspective view of the support attachment of FIG. 7 with extended guides.
FIG. 8*a* is a perspective view of a support attachment similiar to FIGS. 7 and 8, except that the horizontal bar is lowered so as to be closer to the basket's top.
FIG. 9 is a perspective view of the support attachment of FIG. 7 after fitting onto the side of a basket.

A second preferred embodiment **49*b* of the present invention is shown in FIG. 7. Less wire is required for the manufacture of this embodiment so that it is less costly. A horizontal section 50, whose purpose is to separate and stabilize the support at each end, is about 150 mm (6 in) long. The wire is bent downward and inward to form acute angles at 50*b* and 50*c*. The wire is then bent outward and upward to form supports 51 and 51*a* (about 12 to 18 mm ($\frac{1}{2}$ to $\frac{3}{4}$ in) high and rests 52 and 52*a*. The wire is then curved downward, inward, and slightly upward to form almost full circles at 53 and 53*a*, each about 8 mm (5/16 in) in inside diameter. A gap of approximately 3 to 5 mm ($\frac{1}{8}$ to 3/16 in) remains between each end of the wire and respectively rests 52 and 52*a*. Alternatively, the wire end can be bent down to form guides 54 and 54*a*** as shown in FIG. 8. The guides assist fitting the unit onto the basket.

FIG. 8*a* shows a support attachment which is similar to that of FIG. 7 and 8, except that horizontal section 50 is bent down so as to lie close to the basket's top when fitted. Also bends 55 and **55*a* are arranged to more closely fit the contours of top 44 and rim 46** of the basket.

FIG. 9 shows the support attachment **49*b* of FIG. 7 fitted to sides 56 and 56*a* of the basket. At side 56 a plastic bag 34 is supported on attachments 49*b* by bag handle 35. At side 56*a* the support attachment 49*c* shown by a broken line, is first attached and then rolled over in the direction of arrows F and G until rest bends 52 and 52*a* come into contact with top 44** of the basket.

FIGS. 10–11

There are many configurations in which the wire may be bent so that it attaches to the sides of trash baskets to provide ears, extensions, or protrusions that form supports on which to hang or support plastic bags of the type shown in FIG. 2. FIGS. 10–13 shows two more of these.

Figure 10:
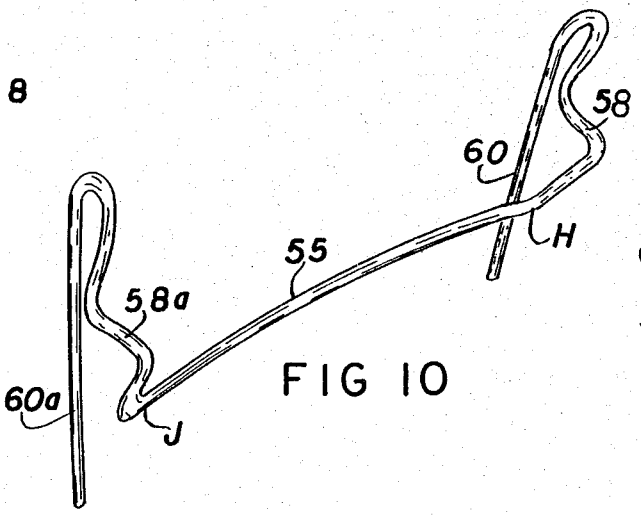
FIG. 10 is a perspective view of another form of wire support attachment according to the invention.
Figure 11:
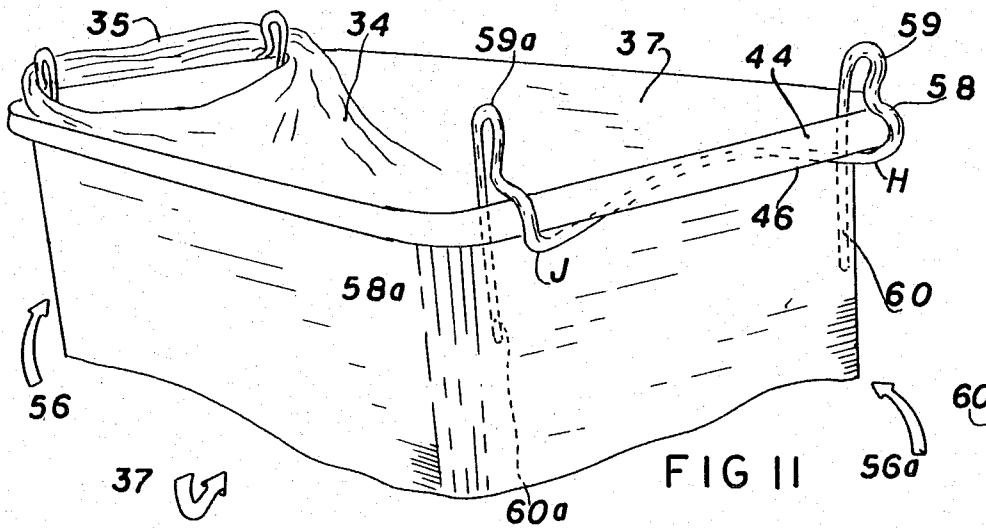
FIG. 11 is a perspective view of the support attachment of FIG. 10 fitted to a trash basket.

In FIG. 10, a wire with a horizontal section 55 is bent up at its center so as to fit up under the outer rim 46 of container 37 (FIG. 11). At two points H and J about 150 mm (6 in) apart, the wire comes below basket rim 46 and is bent upward against the outer face of the rim, then inward to form rests 58 and **58*a* which seat on top 44. At this point the wire is bent up and then down to form supports 59 and 59*a*** about 12 to 18 mm ($\frac{1}{2}$ to $\frac{3}{4}$ in) high.

The wire continues vertically for about 40 to 50 mm (1½ to 2 in) down the inside of the basket to form stabilizers 60 and 60*a*.

In FIG. 11 end 56 of the basket is fitted with this support which holds a bag 34 by its cut-out handles 35. At end 56*a* of the basket the support is shown in detail. The manner of installing this attachment is the same as that of FIG. 7.

FIGS. 12–13

Figure 12:
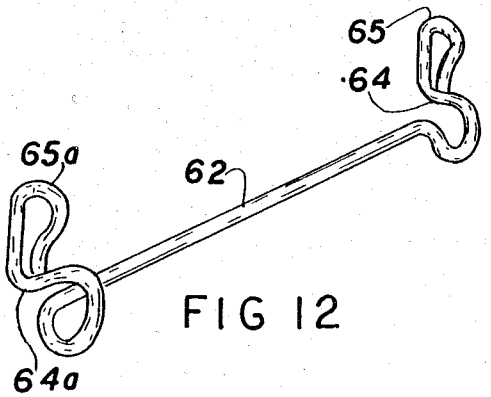
FIG. 12 is a perspective view of another form of wire support attachment according to the invention.

FIG. 12 shows a wire with straight horizontal section 62 which fits up under rim 46 for its full length before being bent down, out and up the outside face of rim 46, then inwards to form rests 64 and 64*a*. Supports 65 and 65*a* are 12 to 18 mm (½ to ¾ in) high and are formed by bending the wire up sharply, then out and down so that its ends meet the top portion of rests 64 and 64*a*. This support is installed in a similar manner to that of FIGS. 7, 8, 8*a* and 10.

Figure 13:
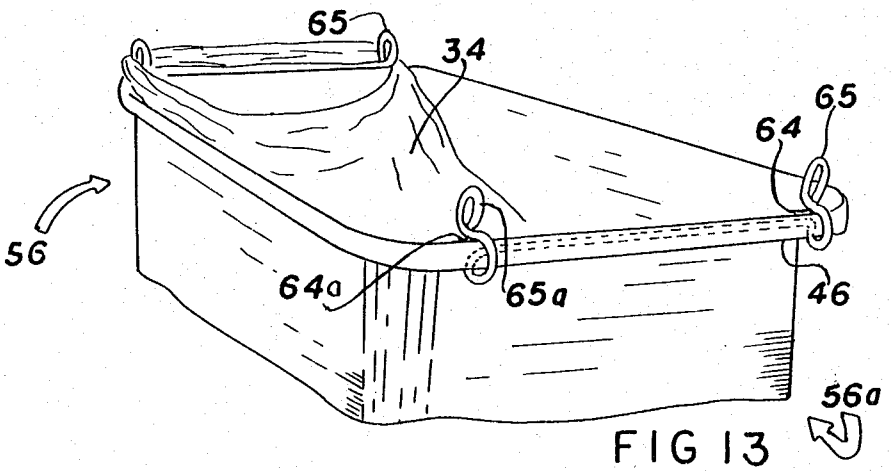
FIG. 13 is a perspective view of the support attachment of FIG. 12 fitted to a trash basket.

FIG. 13 shows in detail how this attachment is fitted onto the side 56*a*, while at side 56 bag 34 is attached by its handles on support 65.

The installation proceedure for the support attachment of FIG. 13 is similar to that for the preceeding attachment.

All the preceeding supports have ends which are spaced apart by a horizontal section. This not only separates the support ends but also assists in stabilizing them. Pairs of supports may also be made of other materials and with other techniques. For instance, pressure injection, casting, forming, pressing and fabricating. The following are some examples of these.

FIGS. 14–15

Figure 15:
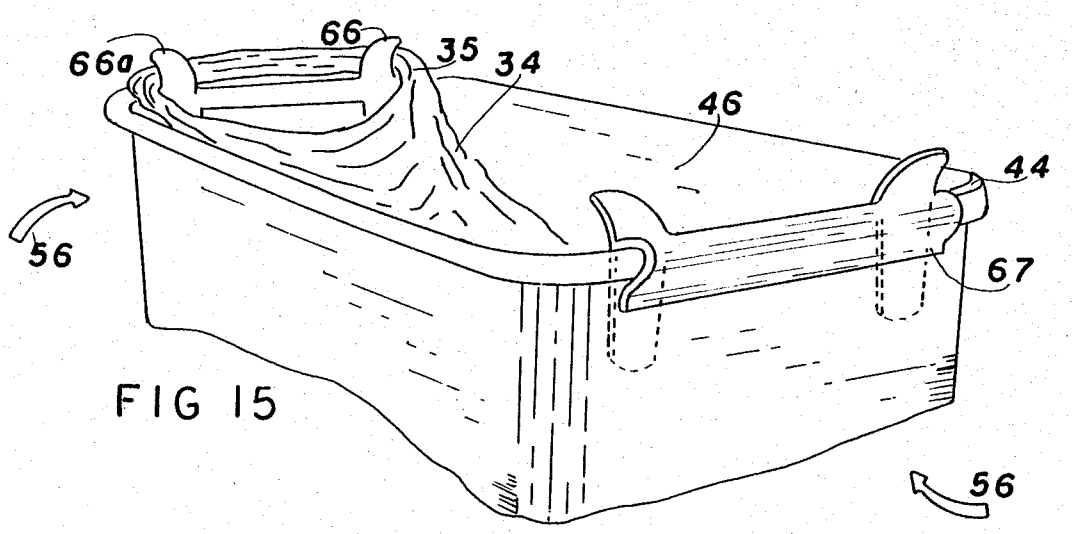
FIG. 15 is a perspective view of the support attachment of FIG. 14 fitted to a trash basket.
Figure 14:
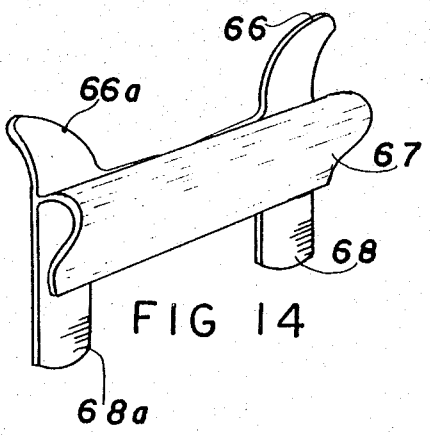
FIG. 14 is a perspective view of a plastic support attachment of the invention.

FIG. 14 shos a support made of plastic; it consists of support ears 66 and 66*a* integral with a clamp-on channel channel 67, and vertical section 68 and 68*a*. FIG. 15 shows this support pressed down into position so that channel 67 fits over and clamps against top 44 of the container 46 at side 56*a*. Side 56 of the basket is shown with bag 34 supported by handle 35 over support ears 66 and 66*a*.

FIGS. 16–17

Figure 17:
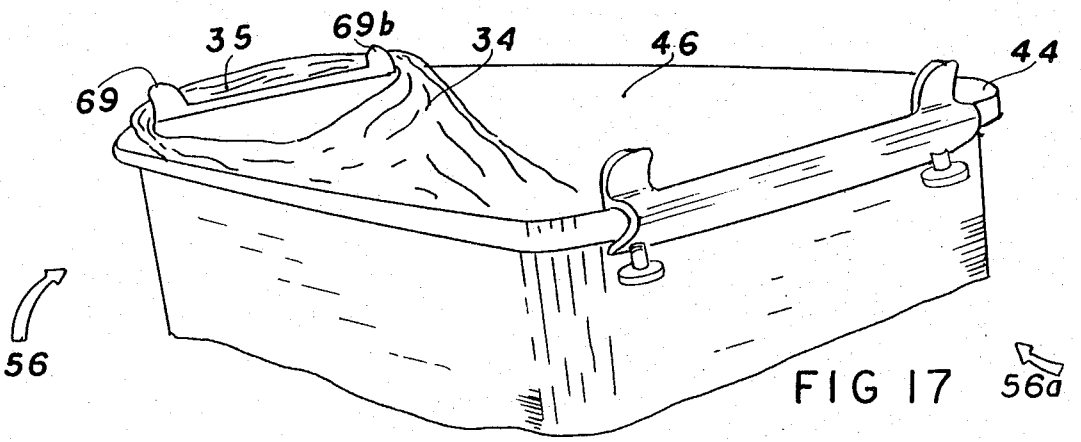
FIG. 17 is a perspective view of the support attachment of FIG. 16 fitted to a trash basket.
Figure 16:
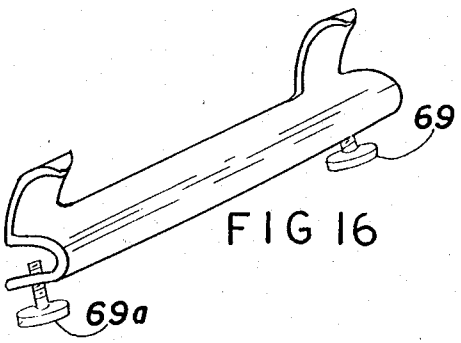
FIG. 16 is a perspective view of another form of plastic support attachment with tightening screw.

Another form of plastic support is shown in FIG. 16. Here attachment is accomplished by screws 69 and 69*a*. The holding arrangement is clearly shown in FIG. 17 at side 56*a* of the container, while side 56 shows a bag 34 and handles 35 fitted over ears or supports 69*b* and 69*c*.

FIGS. 18–19

Figures 18, 18A, 19, 20, 21, 22, 23:
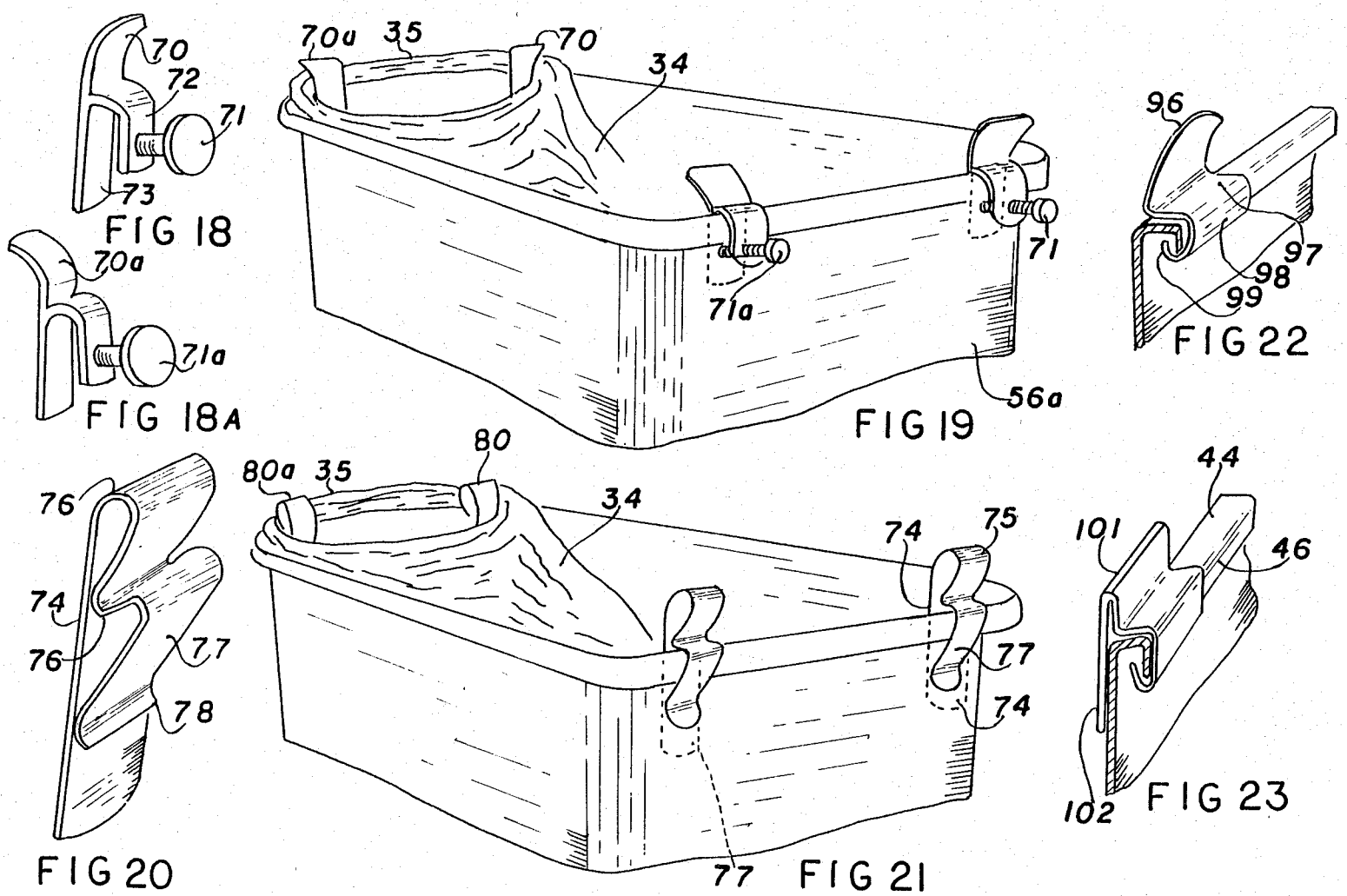
FIG. 18 is a perspective view of a single plastic support attachment according to the invention.
FIG. 19 is a perspective view of a pair of plastic support attachments of FIG. 18 and 18*a* fitted to a trash basket.
FIG. 20 is a perspective view of a single spring steel support attachment.
FIG. 21 is a perspective view of a pair of support attachments of FIG. 20 fitted to a trash basket.
FIG. 22 is a perspective and part sectional view of another form of single metal support attachment fitted to a portion of a trash basket.
FIG. 23 is a perspective and part sectional view of another form of single metal support attachment fitted to a portion of a trash basket.

Still another form of support can be made with individual ear portions and attached to trash baskets in cooperating pairs. A righthand support is shown in FIG. 18. It may be made of metal or plastic and provides a support ear or extension 70 which has a lug 72 with a tightening screw 71 and a vertical section 73. The lefthand support is shown in FIG. 18*a* and is basically the same as the righthand support, except that the support ear or extension is curved in the opposite direction, as shown in 70*a*, FIG. 18*a*. These single unit supports are fitted in pairs and about 125 mm (5 in) apart as shown in FIG. 19, on end 56*a* of the basket. They are secured by tightening screws 71 and 71*a*. The other side 56 shows a bag 34 supported by handles 35 on support ears 70 and 70*a*.

FIGS. 20–21

FIG. 20 shows another form of press-down-clip-on support which is made from flat spring steel material. It provides a vertical section 74, a projecting portion 75 which forms the support portion, a seat 76, a pressure tang 77, and a guide 78 to simplify fitting the unit to a basket top. FIG. 21 shows two such supports fitted to side 56*a* of the basket. Side 56 shows bag 34 with a handle 35 looped over spring steel supports 80 and 80*a*.

FIG. 22

FIG. 22 shows a support which can be permanently fitted onto the trash basket. It can be made from any malleable sheet metal such as mild steel, aluminium, brass, copper, and the like. As is clearly shown in FIG. 22, it consists of an extension support ear 96 bent to form a seat 97 and then bent down and up to form a channel part 98 and lip 99. After fitting and positioning in place, it is clamped tightly to the basket rim by crimping lip 99 and channel part 98 against rim 46 with a pair of pliers.

FIG. 23

FIG. 23 shows a similar support to that of FIG. 22, except that support 101 is bent down vertically to form a stabilizing section 102.

FIG. 24

With the exception of FIGS. 22 and 23, all trash bag supports illustrated heretofore are mechanically fitted and are removable. The following four types of trash bag supports, however are fitted by adhesives and are permanent fixtures.

Figures 24, 25, 26, 27, 28:
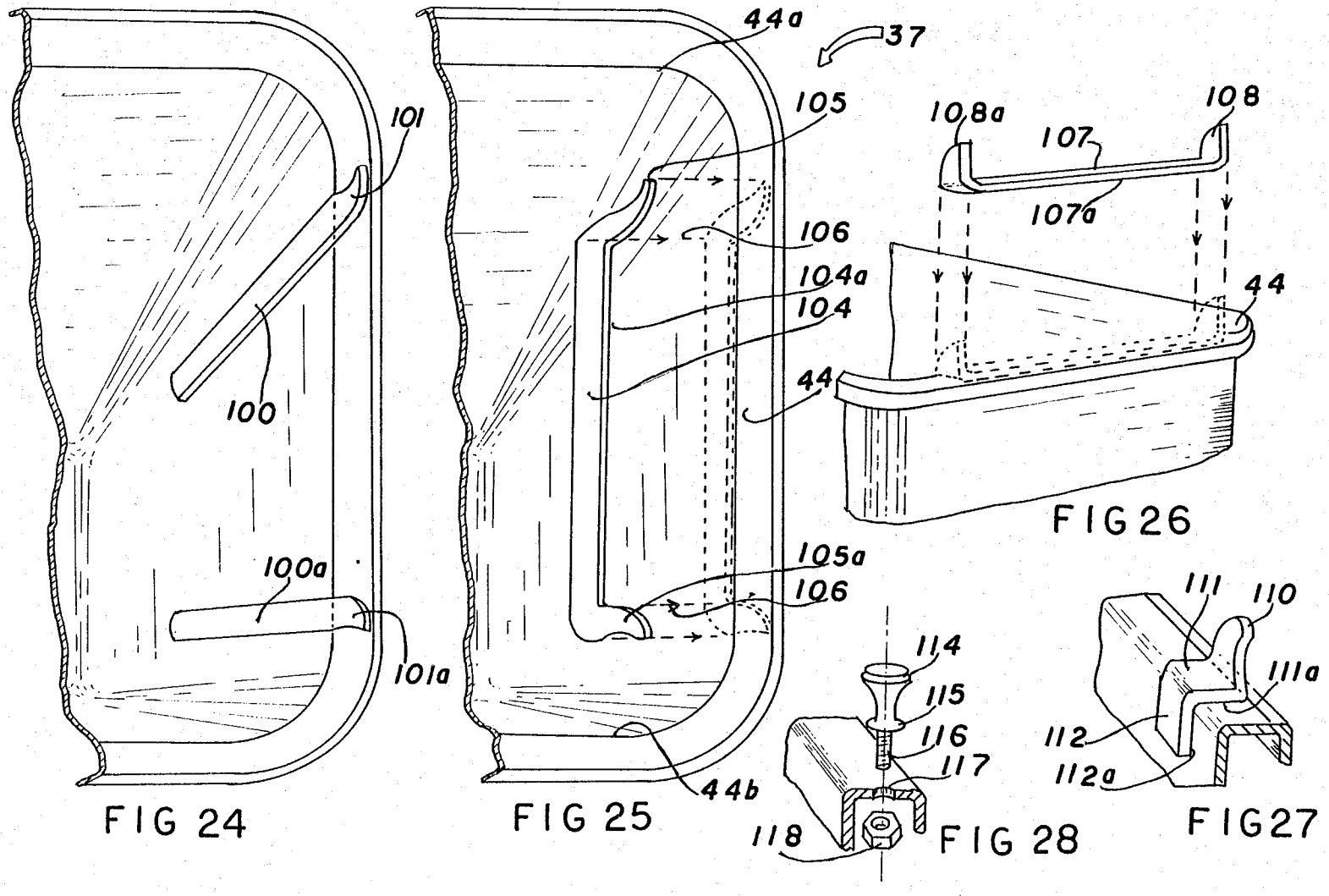
FIG. 24 is a top perspective view of adhesively attached blade-type supports fitted to the inside of a trash basket.
FIG. 25 is a top exploded perspective view of two single adhesively attached supports fitted to the inside of a trash basket.
FIG. 26 is an exploded perspective view of an adhesively attached bag support fitted to the top edge of a trash basket.
FIG. 27 is a perspective part sectional view of a single adhesively attached support fitted to the top and inside of a trash basket.
FIG. 28 is an exploded part sectional view of a knob type support fitted through a hole in the top of a trash basket.

FIG. 24 shows two single blade-shaped plastic supports 100 and 100*a* about 75 mm (3 in) long and 12 mm (½ in) wide, and 3 mm (⅛ in) thick. Protruding ends 101 and 101*a* preferably are scalloped on the outside edge and rounded on the inside edge to form effective hooks for plastic bag handles 35. The adhesive can be factory applied and covered with a protective release paper or other cover, which is removed prior to attachment.

FIG. 25

FIG. 25 shows a pair of support ears 105 and 105*a* integrally made with a horizontal section 104. The adhesive is factory applied to the inside of horizontal section 104 and protected by a removable protective covering. For attachment the top edge 104*a* is attached so that it is level with top face 44 of basket 37 as shown in FIG. 25 with equidestant spacing from basket sides 44*a* and 44*b*, as shown by guide lines 106. The supports shown in FIG. 24, 25, and 27 can also be attached to trash baskets with curved sides. The supports are flexible enough to conform to the curve of the basket's sides.

FIG. 26

FIG. 26 shows a support having a horizontal section 107 and vertical projection 108 and 108*a* at each end. These protrude above basket top 34, when fitted, thereby to form bag supports. The bottom face 107*a* of section 107 have an adhesive coating which is protected with a release covering which is removed prior to attachment of the support to top edge 44 of the basket.

FIG. 27

Another form of adhesively attached single bag support is shown in FIG. 27. This support comprises a top vertical or lug portion 110, a flat center section 111, and a bottom vertical section 112. The bottom surface 111*a* of flat surface 111 and inside surface 112*a* of bottom vertical section 112 have an adhesive coating which is protected with a removable covering, as in the support of FIG. 26. They are spaced the desired distance apart and attached to top 44 of the container.

FIG. 28

Another simple form of bag support is shown in FIG. 28. This comprises an elongated member having an extended knob 114, a flange 115, and a threaded portion 116 which is secured with a nut 118. A hole 117 is drilled through basket top 44 at two desired locations usually about 150 mm (6 in) apart at each side of the basket. A support knob threaded portion 116 is passed through each hole 117 and is secured with a nut 118. These supports are removable and can be adjusted in width by drilling other holes.

FIGS. 29–38

There are many different basket top designs among the many brands of trash baskets on the market today. These designs have significent differences, such that each embodiment described herein has some advantage over others, relative to the type of basket to which it is fitted.

The embodiment of FIGS. 29–38, however, is considered to have the greatest number of advantages over all others heretofore described and is therefore the presently preferred embodiment. Those advantages are: it is reversible, that is to say, if it will not fit onto the basket side the normal way, it can be turned around and will fit the opposite way, it has fewer and less intricate bends, it is easy to attach to the basket, it holds onto the basket more firmly, it is easy to manufacture from circles or ellipses of wire, it has no sharp wire ends which might scratch or damage a basket or a person or child who might play with it, it is attractive in appearance, it is easy to package, say in plastic bags or on labels, it is removable from a basket, it lends itself to mass production, and it can be made of brass, plastics, non-ferrous metals and alloys, mild steel, spring steel, or (preferably) high tensile steel for long life and durability.

As before stated, it is made by forming a starting ellipse or circle (hoop) of wire (not shown), of about 150 mm (6 in) in diameter. The hoop or ellipse is bent along a line approximately through its center, as shown at 121 and 121*a* FIG. 29. This bend forms rests 122 and 122*a* on the top half and semi-circle 123 on the bottom half which acts as a stabilizer, a clamp-on pressure portion, and a spacer between the two support ears on which the plastic bag is hung. A second bend is formed at 124 and 124*a* so that the wire is almost vertical. This portion forms the base of support ears 125 and 125*a*. A third bend 126 and 126*a* completes support ears 125 and 125*a*. A forth bend at 127 and 127*a*, which forms a second cooperating pressure portion 128 which clamps support attachment 120 in position on the trash basket.

Figures 29, 30, 31, 32, 33:
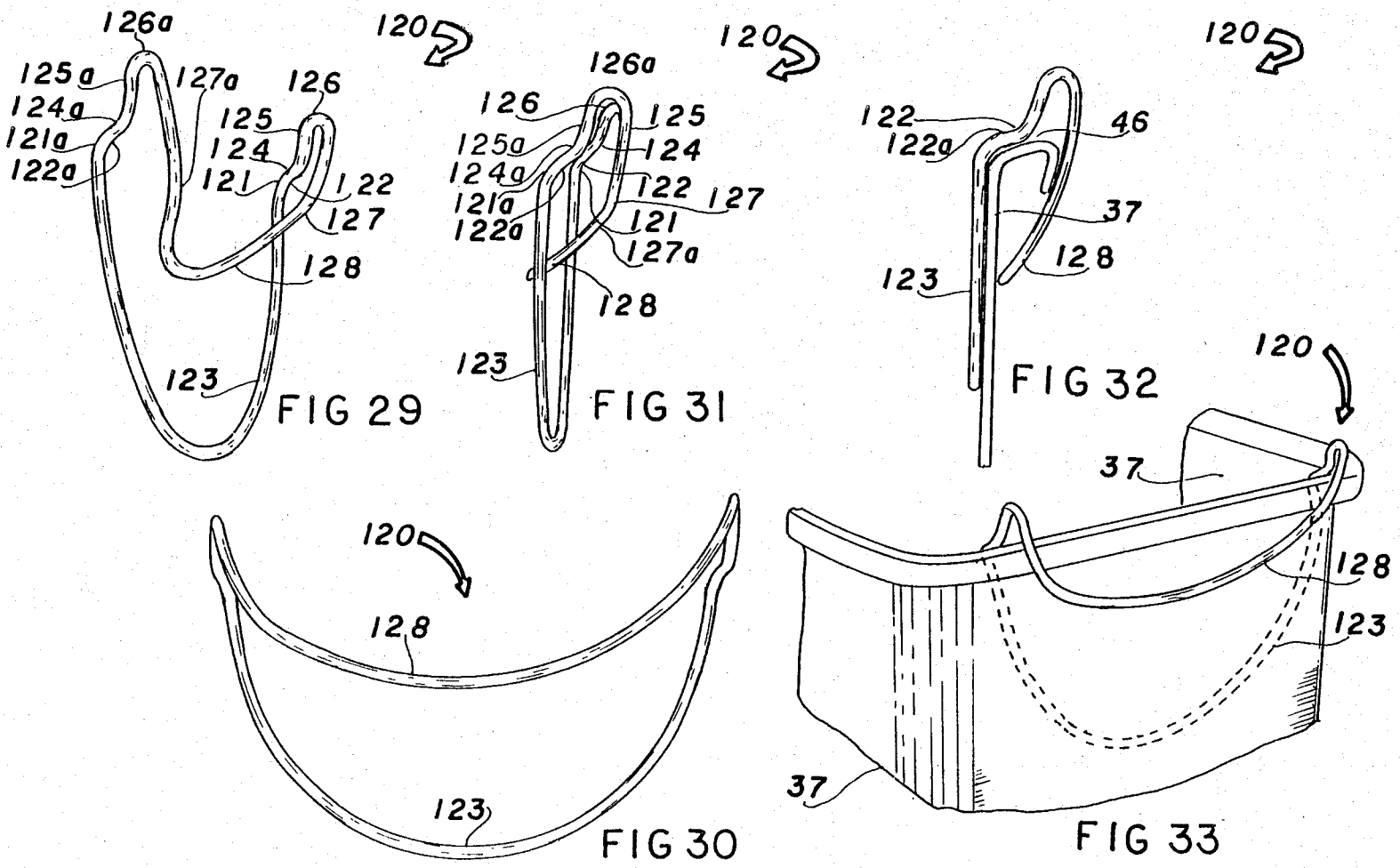
FIG. 29 is a perspective view of a reversible support attachment according to the invention.
FIG. 30 is a front perspective view of the attachment of FIG. 29.
FIG. 31 is a side perspective view of the attachment of FIG. 29.
FIG. 32 is a part side part sectional view of the attachment of FIG. 29 and basket side and top.
FIG. 33 is a perspective view of the attachment of FIG. 29 fitted to one end of a trash basket.

FIG. 30 shows a side view of support attachment 120. As can be seen, pressure portion 123 and cooperating pressure portion 128 are at different levels. Pressure portions 123 and 128 thus form two legs of a generally "U" shaped arrangement wherein the leg of the "U" is shorter and is bent toward the other leg.

FIG. 31 shows a side view of support attachment 120 and clearly shows the bend formations at 121 and 121*a*, seats 122 and 122*a*, second bends 124 and 124*a*, support ears 125 and 125*a* formed by third bends 126 and 126*a*, and forth bends 127 and 127*a* which form cooperating pressure portion 128.

FIG. 32 shows pressure portion 123 against inside face of basket 37 and pressure portion 128 firmly rested against the outside face of basket 37. Also rests 122 and 122*a* are in contact with basket top 46.

FIG. 33 shows the normal way in which support attachment 120 is fitted to side of basket 37 with the pressure portion 123 against the inside face and pressure portion 128 against the outside face of the basket.

Figures 3, 34, 35, 36, 37:
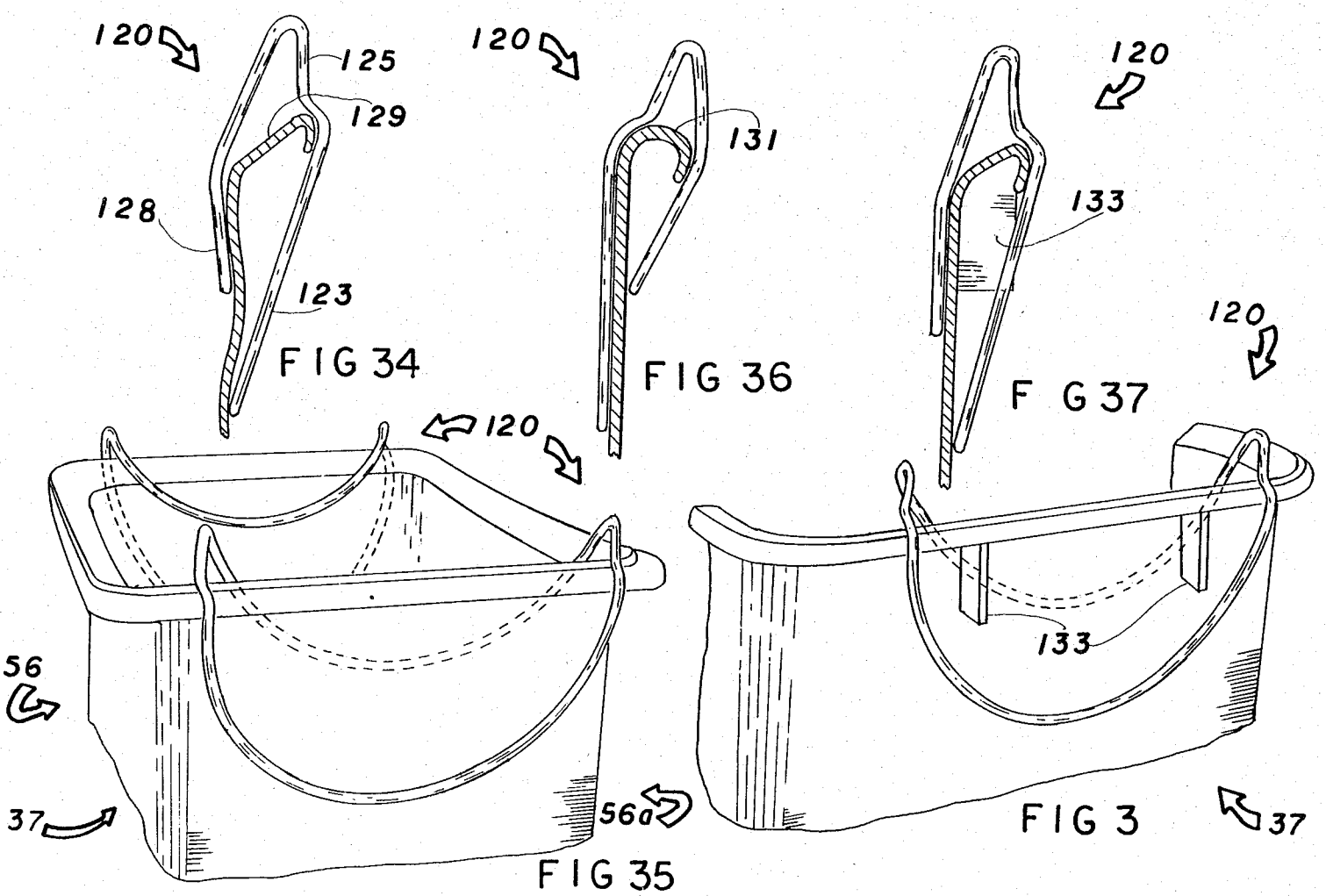
FIG. 34 is a part side part sectional view of the attachment of FIG. 29 fitted in reverse to a basket side shown in cross section.
FIG. 35 is a perspective view of two support attachments of FIG. 29 fitted in reverse to the righthand and lefthand sides of a trash basket.
FIG. 36 is a part side part sectional view of the support attachment of FIG. 29 fitted to a trash basket having a different shaped top.
FIG. 37 is a perspective view of the support attachment of FIG. 29 shown fitted in reverse to a trash basket having two gussets supporting the basket top.

FIG. 34 shows a wider basket top 129 and the attachment 120 of FIG. 29 fitted in reverse with the smaller pressure portion 128 against the inside face while the larger pressure portion 123 against the outside face of the basket. As will be seen, the angle of pressure portion 123 increases, thereby orientating support ears 125 and 125*a* at relatively the same angle to the basket side as they were when the unit was fitted in the "normal" way. This feature insures effective supports for the handles 35 of plastic carrying bags 34, regardless of whether support 120 is fitted in normal or reverse position on a trash basket.

FIG. 35 shows clearly both inside and outside views of support attachment 120 fitted in reverse on the right-hand side 56*a* and lefthand side 56 of basket 37.

FIG. 36 shows a cross section of another shape in a basket top 131 in which attachment 120 fits effectively in the normal way. If a basket has strengthening gussets or ribs, such as shown in FIGS. 37 and 38 at 133, the support attachment will not fit in the normal way because its second portion 128 will interfere with such gussets. However support attachment 120 can be fitted in reverse as shown in these figures so that portion 128 will straddle support gusset 133.

It is obvious that there are many other modifications of the attachment are possible. Thus any means for obtaining the same effect of supporting plastic bags (or bags of other substance) with cut-out or otherwise-formed carrying handles onto trash baskets, which are within the scope of the following claims and their legal equivalents, should be considered to be part of the present invention.

I claim:

1. For a trash container having an open mouth at its top and a rim around said open mouth, an attachment for holding a plastic bag having handles in an open condition within said container by hanging said handles from the top of said container at opposite sides thereof, said attachment comprising:

(a) support means which can be removably attached to said rim at the top of said container without altering said container, (b) said support means comprising a pair of members which provide at least two upstanding portions which extend up from said rim above said container at said respective opposite sides of said container, (c) said upstanding portions being shaped to hold said handles of said bag at said respective opposite sides of said container and to suspend said bag within said container by said handles, (d) each of said pair of members being bent into a configuration which provides grasping means for holding each member rigidly to one side of said container such that:

(1) respective portions of said member are positioned on opposite sides of said rim so that said respective portions of said member provide a sufficient grasp of said rim to hold said member to said rim without altering said rim, (2) each of said members can be removed from said rim by simply withdrawing said respective portions thereof from said rim, and (3) said upstanding portions of said support means extend up from said respective members at the respective sides of said container.

2. The attachment of claim 1 wherein each of said members comprises a wire.

3. The attachment of claim 2 wherein each of said wires has a relatively straight horizontal section and a pair of end portions, each end portion being at an opposite end of said straight section, each end portion comprising a first part extending generally upward at substantially a right angle from said horizontal section, thereby to provide a pair of upstanding ears from each wire, and a second part bent to extend generally down from the upper end of said first part, said second part having a plurality of bends cooperating with said first part to provide a stop for limiting downward movement of each wire onto said rim of said container and for grasping said container.

4. The attachment of claim 2 wherein each of said wires has a relatively straight horizontal section and a pair of end portions, each end portion being at a respective end of said horizontal portion, each end portion having a first part extending down from said horizontal portion at a substantially right angle from said horizontal portion, and a second portion comprising an open loop portion extending from the end of said first part, beginning at a substantially right angle thereto and then curving down and around back to said first part, thereby to provide a loop portion which can be hooked around said rim of said container.

5. The attachment of claim 2 wherein each of said wires has a horizontal portion which is relatively straight and a pair of end portions which extend from the respective ends of said horizontal portion, each end portion having a first part extending up from said horizontal portion at a substantially right angle bend, and a second part extending down from the end of said first part in a substantially U-shaped bend, said first part having a plurality of bends therein for cooperating with said second part for holding said wire onto the rim of said container and for limiting downward movement of said wire onto said container, said second part being relatively straight and extending below the level of said horizontal portion.

6. The attachment of claim 1 wherein each of said upstanding portions comprises a pair of upstanding ears and said rim-grasping means comprises an elongated U-shaped horizontal grasping strip, said ears extending up from the opposite ends of said strip.

7. The attachment of claim 6 wherein said bag-handle holding means comprises a pair of upstanding ears and said rim-grasping means comprises an elongated U-shaped member having a pair of screw clamps thereon.

8. The attachment of claim 1 wherein said support means comprises two pairs of holders, each having an upstanding ear and means for grasping said rim of said container.

9. The attachment of claim 8 wherein each holder comprises a U-shaped part facing downward ahd having said ear extending up therefrom, and a screw clamp on said U-shaped part.

10. The attachment of claim 8 wherein each holder comprises a U-shaped member having two legs, one of which is straight and the other of which has a plurality of bends, one of which is arranged to limit downward movement of said member onto said container and the other of which is arranged to grasp said container, the bight portion of said U-shaped member extending up from said container and forming said upstanding ear when said member is attached to said container.

11. The attachment of claim 8 wherein said holder comprises a bent member having an upstanding ear portion and a bent portion shaped to extend around and grasp said rim of said container.

12. The attachment of claim 11 wherein the ear portion of each holder comprises a folded portion which opens downward, one side of which is straight and the other side of which is bent to extend around and grasp the rim of said container.

13. The attachment of claim 12 wherein each of said wires comprises an endless loop bent to have a generally U-shaped configuration when seen from a first direction perpendicular to a side thereof, each side of the resultant structure having a curved configuration when viewed from a second direction perpendicular to said first direction and a face thereof, such that said structure has two major pressure portions, each constituting one of the legs of said "U", one of said pressure portions being shorter than the other in a third direction perpendicular to said first and second directions.

14. The attachment of claim 13 wherein one of said pressure portions has a plurality of bends therein so as to form a plurality of rests on said pressure portion so that when said attachment is placed over the edge of said container, said rests will hold the bight portions of said "U" above said container's edge so as to form a pair of support ears for holding said plastic bag.

15. For a trash container having an open mouth at its top and a rim around its open mouth, an attachment for suspending a plastic bag having handles in an open condition from the top of said container with said handles at opposite sides of said rim of said container, said attachment comprising:

(a) support means comprising a pair of members which can be removably attached to said rim at the top of said container, (b) said support means providing at least two upstanding portions which extend up said rim above said container at spaced locations thereon, (c) said upstanding portions being shaped to hold said handles of said bag apart and to suspend said bag within said container by its handles, (c) said support means comprising at least a pair of members which have adhesive securement means thereon, said adhesive securement means being covered by a protective, peelable strip.

16. The attachment of claim 15 wherein said support means comprises four elongated strips, each having two opposing flat faces, one of which is covered by said adhesive securement means and said protective strip.

17. The attachment of claim 15 wherein said support means comprises two elongated strips, each having two opposing flat faces and a pair of ears formed at the end of each, said ears extending at right angles to said strip, the side of each strip opposite said ears being covered with said adhesive securement means and said protective strip.

18. The attachment of claim 15 wherein said support means comprises four members, each having two bends in opposite directions so as to form a three-part member having a horizontal center portion, and two vertical portions, each extending from an opposite end of said center portion in opposite directions, one side of said horizontal portion and a corresponding side of one of said vertical portions being covered by said adhesive securement means and said protective strip.

19. The attachment of claim 18 wherein said other one of said vertical portions is tapered from a relatively wide width at its point of attachment to said center portion to a relatively narrow width at its free end, thereby to form a support lug.

* * * * *